US008242421B2

(12) United States Patent
Monteleone et al.

(10) Patent No.: US 8,242,421 B2
(45) Date of Patent: Aug. 14, 2012

(54) DUAL HEATING SYSTEM USING MICROWAVE ENERGY

(75) Inventors: Alfred Monteleone, Clintondale, NY (US); Brian Arthur Weit, Red Hook, NY (US)

(73) Assignee: Alternative Power Source, Inc., Poughkeepsie, NY (US)

( * ) Notice: Subject to any disclaimer, the term of this patent is extended or adjusted under 35 U.S.C. 154(b) by 1058 days.

(21) Appl. No.: 12/220,055

(22) Filed: Jul. 21, 2008

(65) Prior Publication Data

US 2008/0283520 A1 Nov. 20, 2008

Related U.S. Application Data

(63) Continuation-in-part of application No. 11/708,624, filed on Feb. 21, 2007, now abandoned.

(51) Int. Cl.
*H05B 6/80* (2006.01)

(52) U.S. Cl. ..... 219/688; 219/710; 219/717; 219/756; 219/761

(58) Field of Classification Search ..... 99/687–689, 99/756, 759

See application file for complete search history.

(56) References Cited

U.S. PATENT DOCUMENTS

| | | | | |
|---|---|---|---|---|
| 4,967,052 | A * | 10/1990 | Krapf | 219/688 |
| 5,702,501 | A * | 12/1997 | Osawa et al. | 75/255 |
| 6,064,047 | A | 5/2000 | Izzo | |
| 6,858,824 | B1 | 2/2005 | Monteleone et al. | |
| 7,002,121 | B2 * | 2/2006 | Monteleone et al. | 219/688 |
| 7,119,312 | B2 | 10/2006 | Sedlmayr | |
| 7,148,457 | B2 | 12/2006 | Cotten et al. | |
| 2004/0149742 | A1 * | 8/2004 | Lescano | 219/688 |

* cited by examiner

*Primary Examiner* — Henry Yuen
*Assistant Examiner* — Jianying Atkisson
(74) *Attorney, Agent, or Firm* — Aziz M. Ahsan; Ahsan & Associates, PLLC.

(57) ABSTRACT

The present invention relates to an apparatus and a method thereof for a dual heating system using microwave energy. The heating system comprises both heating a fluid heating media, and heating domestic hot water. The system includes an enclosure, a heating tank, a magnetron chamber, at least one heating rod with a hollow interior. At least one heat absorbing mixture or media is located within the hollow interior of each heating rod, and a microwave guide is associated with each heating rod to direct heat energy to the heat absorbing media. A magnetron is associated with each microwave wave guide. At least one inlet and at least one outlet for conveying the fluid heating media into and out of the heating tank. At least one inlet and at least one outlet for conveying the domestic hot water into and out of the heating tank.

20 Claims, 5 Drawing Sheets

DUAL HEATING SYSTEM USING MICROWAVE ENERGY

CROSS-REFERENCE TO RELATED APPLICATION

The instant patent application is a Continuation-In-Part patent application of U.S. patent application Ser. No. 11/708,624, filed on Feb. 21, 2007, titled "Heating System," the disclosure of which is incorporated herein by reference.

FIELD OF THE INVENTION

The present invention relates generally to a heating system. More particularly, the invention encompasses an apparatus for a heating system and a method thereof. The invention also includes a heating system using microwave energy. The heating system is preferably provided for heating a heating media and heating domestic hot water. The heating system includes an enclosure and a heating tank which is located within the enclosure. A magnetron chamber is located in the enclosure above the tank. At least one heating rod with a hollow interior extends from the magnetron chamber into the lower compartment. The heating rod has an upper section that is located in the magnetron chamber and a lower section that is located in the tank. At least one heat absorbing mixture or media is located within each heating rod, and a microwave guide is located at the top or upper section of each heating rod. A magnetron is mounted on each microwave wave guide. At least one heating media inlet and at least one heating media outlet serve for conveying the fluid heating media into and out of the heating tank.

BACKGROUND INFORMATION

Microwave energy has in the past been used to provide heat. The most widely known usage of microwave energy is the microwave oven. Microwave energy is clean and efficient. With microwave heat, no heat is lost in flue gases as none exist. An efficient heater utilizing microwave energy for use in both commercial buildings and in residential structures would result in reduced fuel consumption by use of a clean heating system that is comparatively economical.

U.S. Pat. No. 4,967,052 (Edward J. Krapf), the disclosure of which is incorporated herein by reference, discloses a microwave heat pipe heating system which consists of at least one sealed heat pipe having self contained water therein. The heat pipe extends from a microwave containment enclosure into a domestic hot water tank. The self contained water heated by microwave beams will cause the sealed heat pipe extending into the domestic hot water tank to heat water therein for use in a normal water circulation system. In an alternate embodiment a microwave permeable pipe extends through two opposite walls of a microwave containment enclosure for conveying water capable of being heating by microwave beams. The pipe is divided into smaller pipes after entering through one of the walls and reconvening before exiting through other of the walls of the microwave containment enclosure to expose more water surface area to the microwave beams to enhance the heating efficiency of the microwave beams.

U.S. Pat. No. 6,064,047 (Daniel R. Izzo), the disclosure of which is incorporated herein by reference, discloses a microwave hot water boiler heating system which includes a water tank with a water boiler circulator and a water refill valve and a water drain valve and a cooled water pipe that comes from the steam cooling chamber. A vacuum pump is employed to depressurize the boiler tank and vacuum pump the steam that is produced by the heated water that was heated by the microwaves coming directly from the magnetron maser. Vacuum pumping the steam from the microwave boiler heating area prevents the pressurization of steam that would damage the machine's magnetron maser. The vacuum pump also will, by its force, draw in air from the boiler tank's air inlet/overflow valve and by its force contain and compress the steam inside of the machine's steam chamber. Both, the water boiler tank and the steam chamber shall have a closed loop of coiled piping that will transfer heat to a room radiator heat exchanger. The closed loop of piping shall be filled with circulating water that is circulated by a circulator pump. Inside of the steam chamber shall be pressure reducing valves that allow for the release of either cooled water or steam. The machine's microwave emitting magnetron maser will operate upon command by a room air temperature sensor/thermostat.

U.S. Pat. No. 6,858,824 (Alfred Monteleone and Brian Weit), the disclosure of which is incorporated herein by reference, discloses a microwave heating system is provided which uses a heat conductive medium. The heat conductive medium is heated in a heater. The heater includes a shell which forms an enclosure. The enclosure has an upper end and a lower end. A heating coil is located in the enclosure. The heating coil has an upper end and a lower end and has an inverted frusto-conical shape. The upper end of the heating coil is larger than the lower end. Three magnetrons are mounted adjacent the heating coil. One magnetron is located at the upper end of the heating coil and the other two magnetrons are located on opposite sides of the heating coil for directing microwave energy into the heating coil. An electrical distribution system is connected to the magnetron. A return line supplies the heat conductive medium into the heating coil adjacent the lower end of the shell. The heat conductive medium is fed through a feed line to a storage tank and into a two-stage domestic hot water heater. The heat conductive medium then flows back to the hater through the return line. A circulator is located in the return line.

U.S. Pat. No. 7,002,121 (Alfred Monteleone and Brian Weit), the disclosure of which is incorporated herein by reference, discloses a steam generator is located within a tank. At one end of the tank there is a flange. Mounted on the outside of the flange there is a magnetron that is cooled by a fan surrounding the magnetron. A heat tube extends from the magnetron into the tank. Within the heat tube there is a block of silicon carbide which has a passageway through it. The magnetron fires microwave energy down the passageway heating the block of silicon carbide and the heat tube. Water tubes about the inside surface of the tank spray a mist of water on the heat tube to produce steam which is removed by a steam line through ports at the opposite end of the tank from the magnetron. The steam may be used for many purposes but in a vehicle it may be injected into the cylinders of a four stroke internal combustion engine through the openings for the spark plugs. Make up water is collected from the dehumidifier. Water is recovered from the crankcase by a float system, and returned to the storage container.

U.S. Pat. No. 7,148,457 (William B. Cotten, et al.), the disclosure of which is incorporated herein by reference, discloses a microwave water heating system includes a metal casing having an outer wall defining an interior casing chamber. An inner housing is positioned within the casing and includes an outer wall displaced from the casing outer wall to form an insulating vacuum space. The inner housing includes an inlet port connected to an upstream water source and an outlet port connected to a downstream conduit. The casing and inner housing include generally spherical configurations.

The inner housing is configured to induce a vortex of a water stream flowing between inlet and outlet ports. At least one magnetron is mounted to the casing for transmitting microwaves into the inner housing for heating the water stream at the vortex. A float valve in the inner housing allows the water stream to flow and be heated upon demand as the valve operates according to upstream and downstream pressure differentials.

U.S. Pat. No. 7,119,312 (Steven R. Sedlmayr), the disclosure of which is incorporated herein by reference, discloses a microwave energy emitter (108) which is positioned in a microwave transparent chamber (123) within a fluid holding vessel (106) of a microwave containment vessel (122). The fluid holding vessel (106) may be transparent to microwave energy and is further provided with a microwave reflective component outward, on, or beyond an exterior surface (121) of the wall of the fluid holding vessel (106). The microwave reflective component reflects microwaves back into the fluid holding vessel (106). The fluid holding vessel (106) encloses a material that absorbs microwave energy. An inlet path (116) and outlet path (112) is provided for material to flow in and out of the holding vessel upon predetermined conditions. Heated material can be condensed via a condenser (124) into a collection vessel (120). A controller (126) is provided to send control signals to a switching device (100) for controlling the material flow and receiving sensing signals for decision generation.

Even with these improvements, and known problems of the prior art, a need exists for an improved heating system.

Thus, a need exists for an improved heating system.

A need also exists for a heating system that uses microwave energy.

The invention provides an apparatus for a heating system which uses microwave energy and a method thereof.

PURPOSES AND SUMMARY OF THE INVENTION

The invention is a novel method and apparatus for a heating system.

Therefore, one purpose of this invention is to provide a novel heating system.

Another purpose of this invention is to provide a heating system which uses microwave energy.

Yet another purpose of this invention is to heat domestic hot water along with another fluid heating media.

Still yet another purpose of this invention is to heat domestic hot water along with another fluid heating media using at least one heat absorbing mixture or media.

Yet another purpose of this invention is to heat domestic hot water along with another fluid heating media using at least one heat absorbing mixture or media and wherein the at least one heat absorbing mixture or media is heated using at least one source of microwave energy.

Still yet another purpose of this invention is to provide a microwave heating system as follows:

1. That is economical.
2. That is dependable and durable.
3. That is flexible to permit the construction of heating systems of a wide variety of capacities.

Therefore, in one aspect this invention comprises a microwave heating system for heating a heating media and domestic hot water, the microwave heating system comprises:

an enclosure;

at least one tank located within said enclosure;

at least one heating rod extending from a magnetron chamber into said tank, said heating rod includes at least one heat absorbing media within said heating rod;

means including at least one magnetron located in said magnetron chamber for directing microwave energy into said at least one heat absorbing media; and at least one heating media inlet and at least one heating media outlet in said tank for conveying a heating media into and out of said tank.

In another aspect this invention comprises a microwave heating system for heating a heating media and domestic hot water, the microwave heating system comprising:

an enclosure;

at least one tank located within said enclosure;

at least one magnetron chamber located within said enclosure above said tank;

at least one heating rod with a hollow interior extending from said at least one magnetron into said tank, said at least one heating rod having an upper section located in said magnetron chamber and a lower section located in said tank;

at least one heat absorbing media located within each heating rod;

at least one microwave wave guide located at an upper section of each said heating rod;

at least one magnetron mounted on each said microwave wave guide; and at least one heating media inlet and at least one heating media outlet for conveying a fluid heating media into and out of said tank.

In yet another aspect this invention comprises a microwave heating system for heating a fluid heating media and domestic hot water, the heating system comprising:

an enclosure;

at least one tank located within said enclosure;

at least one magnetron chamber located above said at least one tank;

a plurality of heating rods with a hollow interior extending from said magnetron chamber into said at least one tank, said heating rod having an upper section located in said magnetron chamber and a lower section located in said tank;

at least one heat absorbing media located within each said heating rod;

at least one microwave guide located at said upper section of each said heating rod;

at least one magnetron mounted on each said microwave wave guides;

at least one coil for heating domestic hot water coiled about each said heating rod;

at least one coil inlet and at least one coil outlet for conveying domestic hot water into and out of said lower section; and at least one heating media inlet and at least one heating media outlet for conveying a fluid heating media into and out of said lower section.

BRIEF DESCRIPTION OF THE DRAWINGS

The features of the invention that are novel and the elements characteristic of the invention are set forth with particularity in the appended claims. The drawings are for illustration purposes only and are not drawn to scale. Furthermore, like numbers represent like features in the drawings. The invention itself, both as to organization and method of operation, may best be understood by reference to the detailed description which follows taken in conjunction with the accompanying drawings in which:

DETAILED DESCRIPTION

There is provided a heating system for heating a fluid heating media to be used for heating purposes and also for heating domestic hot water. An enclosure includes a magnetron chamber and a tank with at least one heating rod extending from the magnetron chamber into the tank. At least one heat absorbing media is located within the heating rod. Means including a magnetron are used to direct microwave energy into the at least one heat absorbing media.

Figure 1:
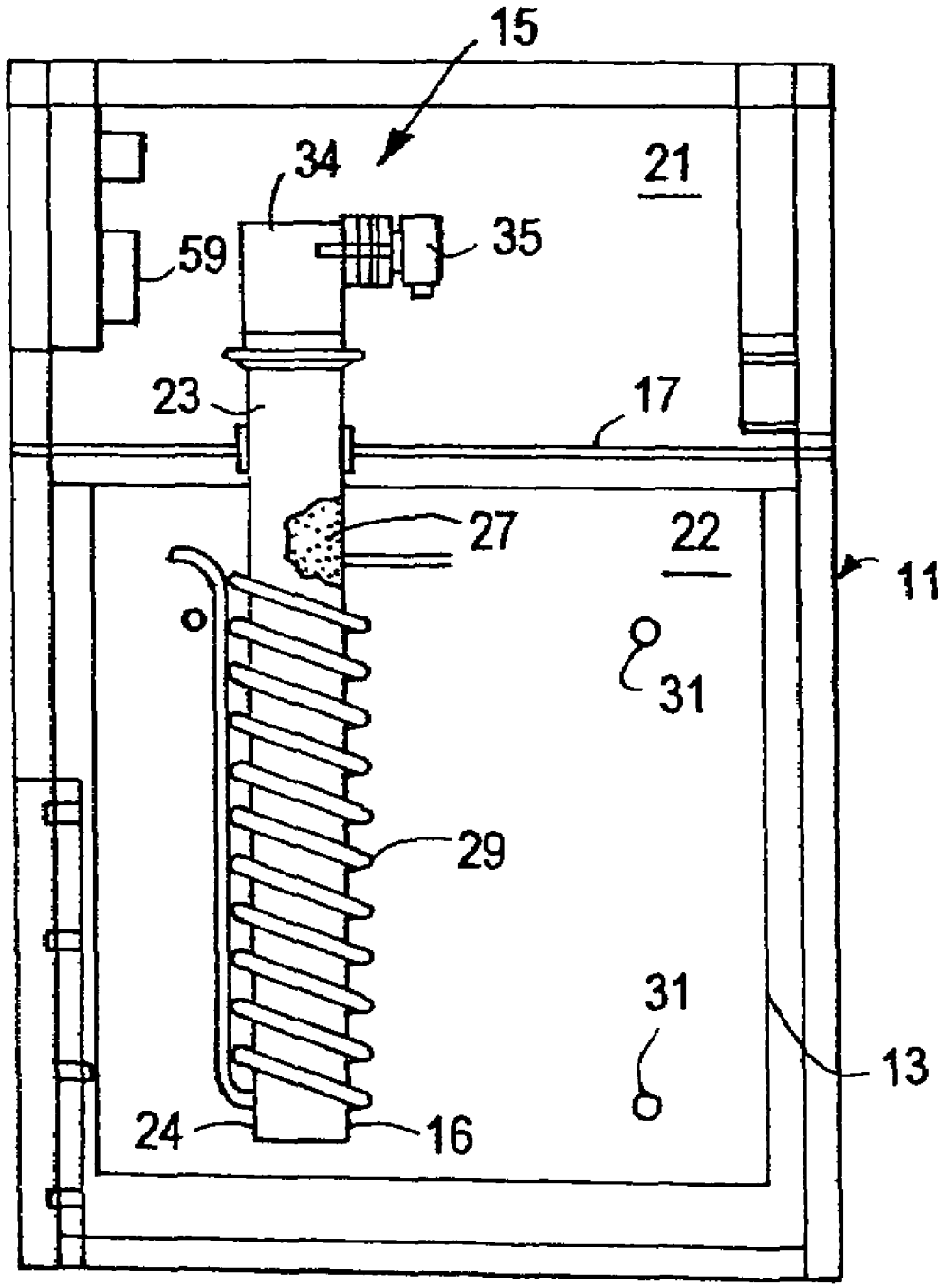
FIG. 1 is a side elevation showing one heating rod within the tank and with the coil for providing domestic hot water wrapped about the one heating rod which is used to illustrate a first embodiment of the present invention.

FIG. 1 is a side elevation showing one heating rod 16, within a tank 13, and with a coil 29, for providing domestic hot water wrapped about the one heating rod 16, which is used to illustrate a first embodiment of the present invention.

Figure 2:
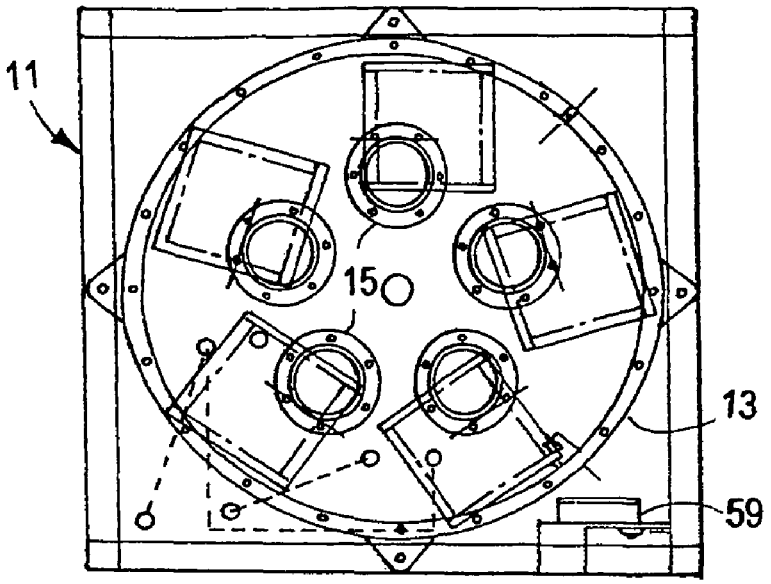
FIG. 2 is a top view of the heating unit with the upper end of the tank removed showing the top of the heating rods.
Figure 4:
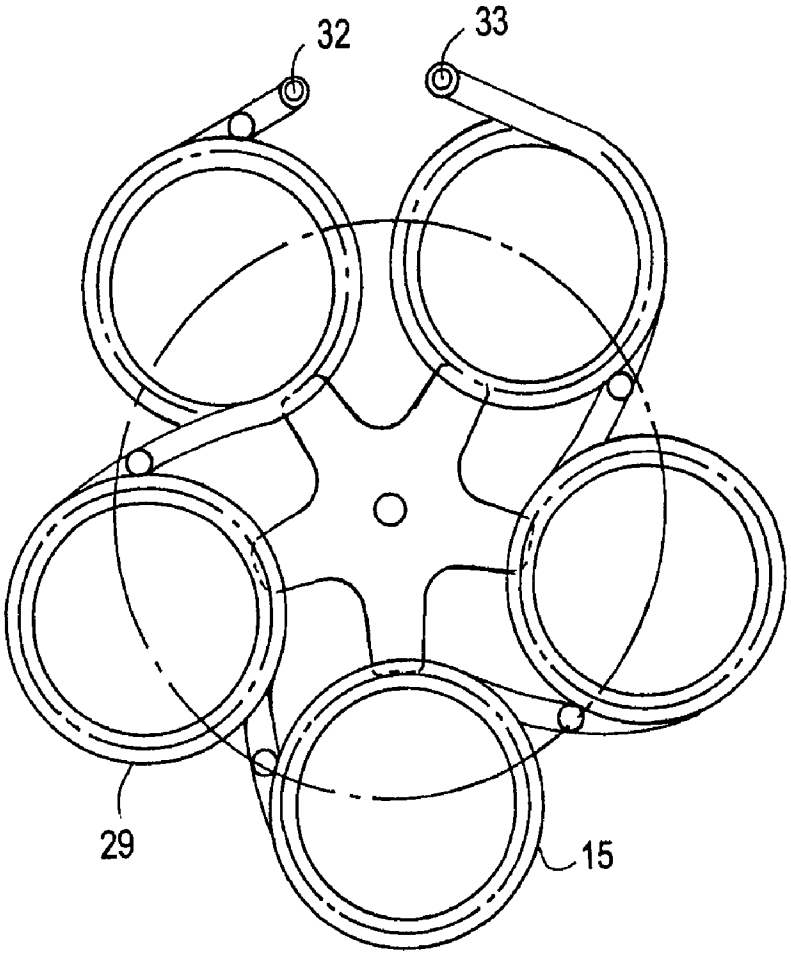
FIG. 4 is a plan view of the heating rods within the tank and with the coil wrapped about the five heating rods within the tank to further illustrate the present invention.

Referring now, in detail, to the Figures, an enclosure 11, is shown with a tank 13, within the enclosure 11, and fills more than half of the enclosure 11. Above the tank 13, and within the enclosure 11, is a magnetron chamber 15. One heating rod 16, is shown in the tank 13, and in the magnetron chamber 15. It should be appreciated that each heating rod 16, has a top or an upper section 23, which is located in the magnetron chamber 15, or in an upper compartment 21, and that a bottom or a lower section 24, of each heating rod 16, is located inside the tank 13. All of the heating rods 16, are located in the tank 13, and in the magnetron chamber 15, in the same manner as shown. All of the heating rods 16, are generally the same and the description of one heating rod 16, pertains to each heating rod 16, regardless of the number of heating rods 16, being utilized in any one enclosure 11. The tank 13, and the magnetron chamber 15, are separated by at least one partition 17, which is essentially horizontal. The tank 13, which preferably has a circular cross section, is located below the partition 17. As best seen in FIGS. 1, 2 and 4, a plurality of heating rods 16, shown as five heating rods 16, are equally spaced in a circle within the tank 13, and the magnetron chamber 15.

Each heating rod 16, is hollow and is filled with at least one heat absorbing media or mixture 27. The heat absorbing mixture or media 27, is primarily sand and/or silicon and may include a variety of other elements to enhance heat absorption. A coil 29, is wound within the tank 13, around the heating rod 16. The tank 13, is filled with a fluid heating media 19, preferably water or water mixed with an additive. The fluid heating media 19, is used for heating purposes, such as, for example, baseboard heating. A pair of temperature probes 31, are mounted in the tank 13. The temperature probes 31, control the temperature of the fluid heating media 19. If a pump (not shown) is used, the pump switch is located in the magnetron chamber 15, within the upper compartment 21.

Domestic hot water which is water used for human consumption, such as, bathing and cooking, and which is usually dispersed through a hot water faucet, is heated by passing such water through the coil 29. It should be understood that the domestic hot water that is contained inside the coil 29, does not co-mingle or interact with the fluid heating media 19, that is contained inside the lower compartment 22. The domestic hot water is preferably conveyed to the coil 29, through a domestic hot water coil inlet 32, and is conveyed out of the tank 13, through a domestic hot water coil outlet 33.

At the top or upper section 23, of each heating rod 16, in the magnetron chamber 15, within the upper compartment 21, is a wave guide 34. A magnetron 35, is attached to the side of the wave guide 34. Microwave energy from the magnetron 35, is directed downwardly by its respective wave guide 34. The microwave energy from the magnetron 35, is thereby directed downwardly by the wave guide 34, into the center of the heating rods 16. The microwave energy serves to heat the heat absorbing mixture or media 27, and thus the heating rods 16, which in turn heat the fluid heating media 19, in the tank 13, and in the coil 29, for the domestic hot water.

The fluid heating media 19, is supplied into the tank 13, through a fluid heating media inlet 39, and is removed through a fluid heating media outlet 41. The fluid heating media 19, may be used for any one of many purposes but is usually used for heating purposes, such as, for example, baseboard heating.

FIG. 2 is a top view of the heating unit with the upper end of the tank 13, removed showing the top of the heating rods 16. Also shown is a fan 59, and the enclosure 11.

Figure 3:
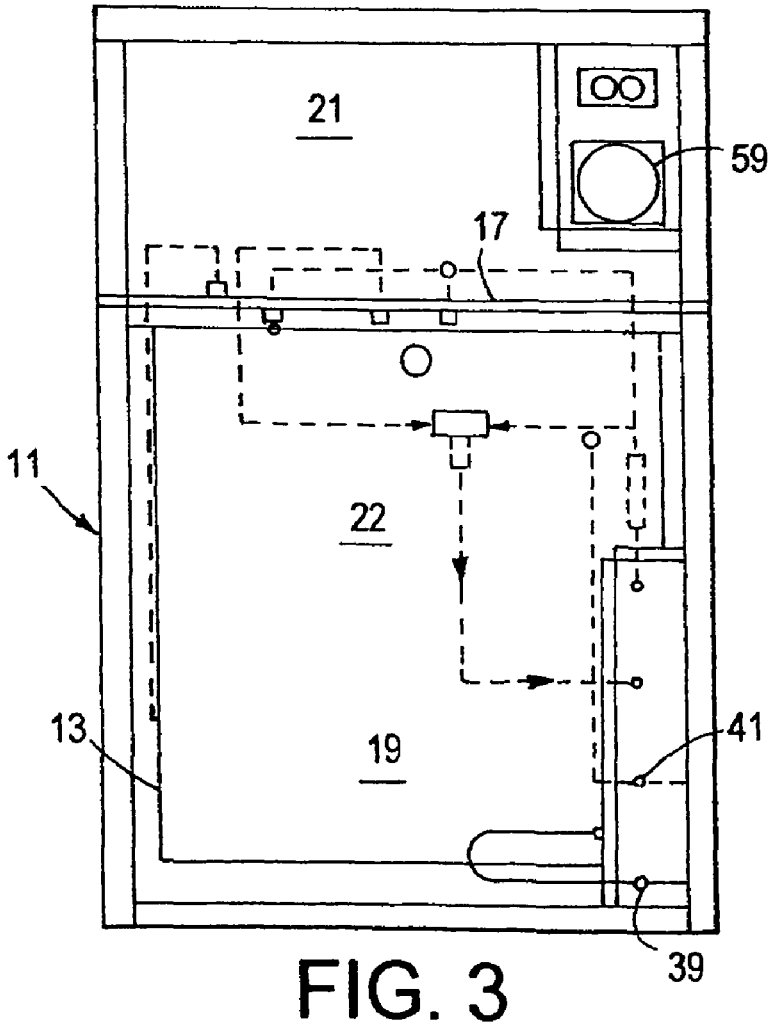
FIG. 3 shows the float, in a side elevation of the heating unit with the heating rods and the microwave units omitted.

FIG. 3 shows the float, in a side elevation of the heating unit with the heating rods 16, and the microwave units omitted. The upper compartment 21, above the partition 17, has the fan 59. The lower compartment 22, below the partition 17, has the tank 13, containing the fluid heating media 19, and having the fluid heating media inlet 39, and the fluid heating media outlet 41.

FIG. 4 is a plan view of the heating rods 16, within the tank 13, and with the coil 29, wrapped about the five heating rods 16, within the tank 13, to further illustrate the present invention. Also shown is the coil inlet 32, for the passage of domestic water that that has not yet been heated, and a coil outlet 33, for the passage of domestic water that has been heated according to the teachings and disclosure of this invention.

Figure 5:
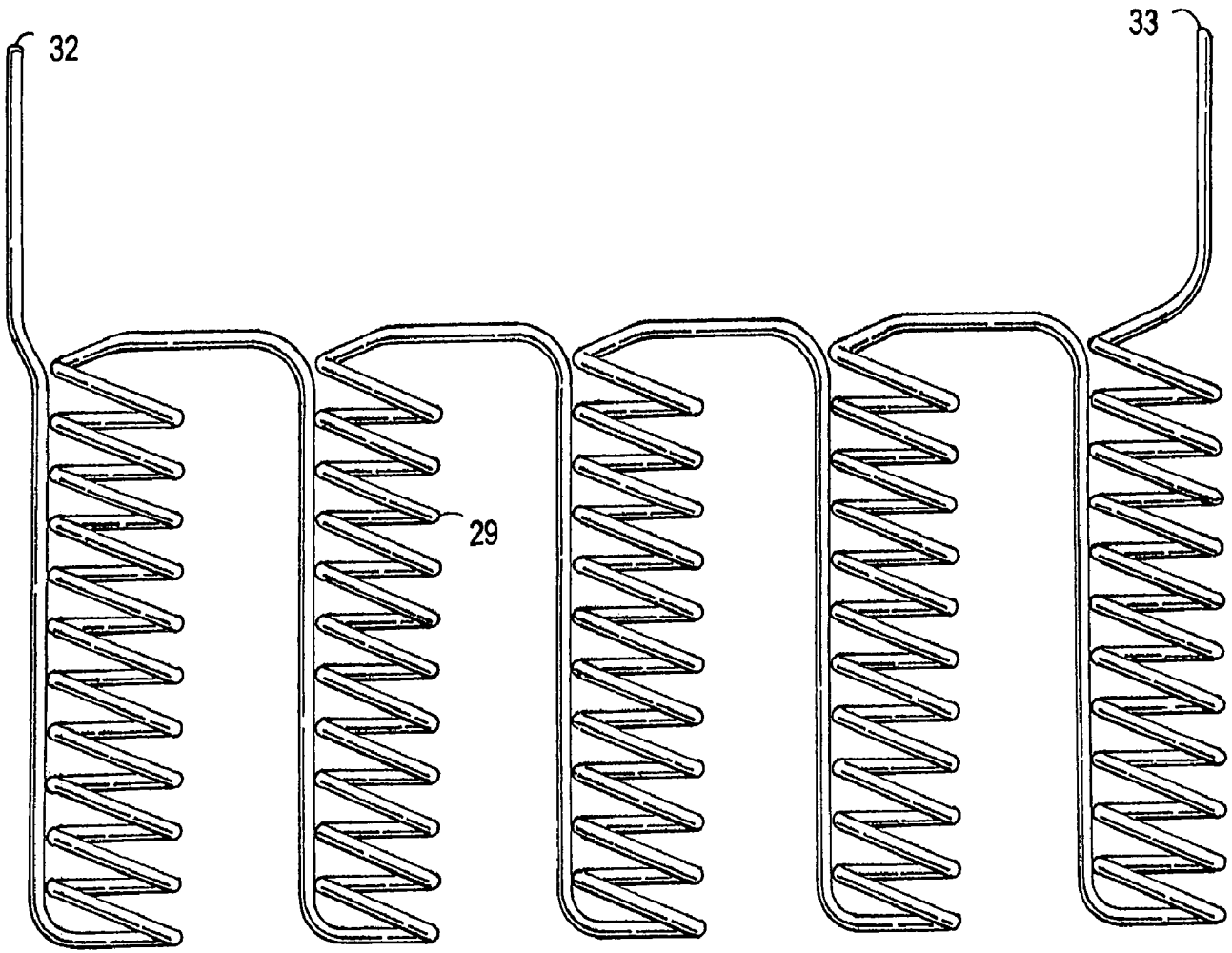
FIG. 5 is a side elevation of the five heating rods but in a single plane.

FIG. 5 is a side elevation of the five heating rods 16, but in a single plane. As shown the coil 29, is coiled or wrapped around each of the heating rod 16, and preferably having a single domestic hot water inlet 32, and preferably having a single domestic hot water outlet 33.

Figure 6:
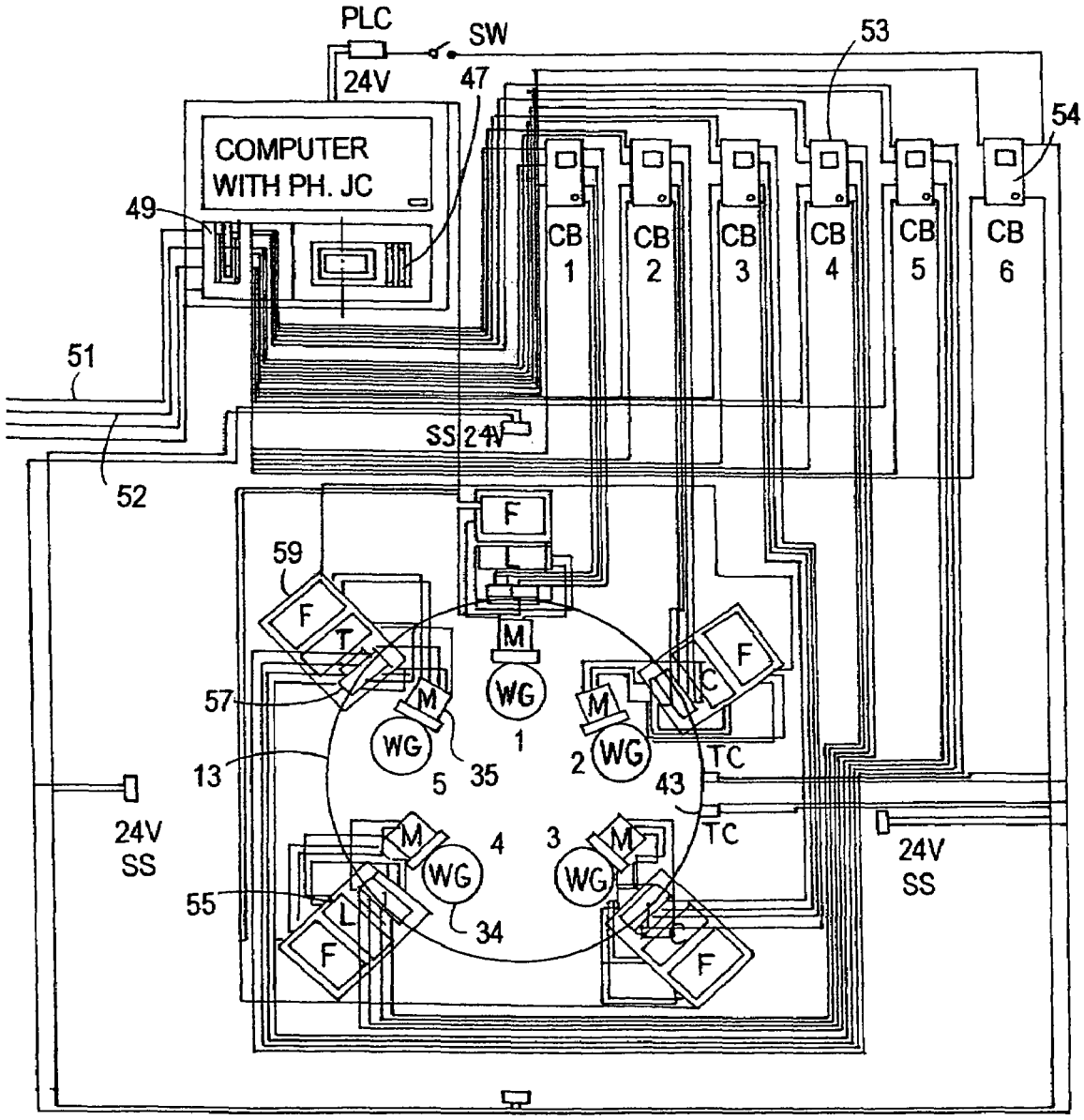
FIG. 6 is a schematic view of the electrical circuitry including the tank without the enclosure.

FIG. 6 is a schematic view of the electrical circuitry including the tank 13, without the enclosure 11.

Referring now to FIG. 6, the operating circuit for the five magnetrons (M) 35, and a thermal coupler (TC) 43, is shown. A computer 45, is actuated by means of a key pad 47, and a main circuit breaker 49. The voltage supplied is two hundred twenty volts through two electric lines 51, 52, each supplying one hundred ten volts. The two electric supply lines 51, 52 are connected to each of five circuit breakers (CB) 53, and from each such circuit breaker (CB) 53, to one of the five magnetrons (M) 35. A sixth circuit breaker (CB) 54, is also connected to the thermal coupler (TC) 43.

Still referring now to FIG. 6, each of the five coils 29, are shown equally spaced about the tank 13. The wave guide (WG) 34, as previously stated, is placed at the top of each heating rod 16, and to the side of each wave guide (WG) 34, is the magnetron (M) 35. The magnetron (M) 35, generates microwave energy which the wave guide (WG) 34, directs down the hollow center of its respective heating rod 16. A capacitor (C) 55 activates the magnetron (M) 35 through a transformer (T) 57. A fan (F) 59 blows on the capacitor (C) 55 and the transformer (T) 57 for cooling purposes. The fan (F) 59 may also be seen in FIG. 3 located in the upper compartment 21, above the partition 17.

The heat absorbing mixture or media 27, could be selected from a group comprising, silicon carbide, silicon, silica, iron impregnated quartz, sand, to name a few. For some applications it is preferred to have a mixture of silicon carbide, silica and iron impregnated quartz. For such applications it is preferred that the silicon carbide, silica and iron impregnated quartz are all in about a one third proportion. For some applications it is preferred that the content of silicon carbide is between about 23 percent to about 43 percent of the content of the heat absorbing media 27, and preferably between about 28 percent to about 38 percent of the content of the heat absorbing media 27, and more preferably between about 31 percent to about 35 percent of the content of the heat absorbing media 27. For some applications it is preferred that the content of silica is between about 23 percent to about 43 percent of the content of the heat absorbing media 27, and preferably between about 28 percent to about 38 percent of the content of the heat absorbing media 27, and more preferably between about 31 percent to about 35 percent of the content of the heat absorbing media 27. For some applications it is preferred that the content of iron impregnated quartz is between about 23 percent to about 43 percent of the content of the heat absorbing media 27, and preferably between about 28 percent to about 38 percent of the content of the heat absorbing media 27, and more preferably between about 31 percent to about 35 percent of the content of the heat absorbing media 27.

For some applications it is preferred that at least one content of the heat absorbing media 27, is selected from a group comprising a fine powder, a granular powder, a fine dust, a granular dust, to name a few.

While the present invention has been particularly described in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

What is claimed is:

1. A dual microwave heating system for heating a heating media and domestic hot water, the microwave heating system comprises:

an enclosure;

at least one tank located within said enclosure;

at least one heating rod having a hollow interior extending from a magnetron chamber within said enclosure into said at least one tank, said at least one heating rod includes at least one heat absorbing media within said hollow interior of said at least one heating rod;

means including at least one magnetron located in said magnetron chamber for directing microwave energy into said at least one heat absorbing media, and wherein said at least one heat absorbing, media heats said at least one heating rod, and wherein said at least one heating rod heats said heating media and said domestic hot water;

at least one heating media inlet and at least one heating media outlet in said at least one tank for conveying said heating media into and out of said at least one tank;

at least one domestic hot water inlet and at least one domestic hot water outlet in said at least one tank for conveying a domestic hot water into and out of said at least one tank;

wherein said heating media and said domestic hot water do not comingle;

wherein said at least one heating, media inlet operates independent from said at least one domestic hot water inlet; and wherein said at least one heating media outlet operates independent from said at least one domestic hot water outlet, and thereby forming said dual microwave heating system for heating said heating media and domestic hot water.

2. The microwave heating system according to claim 1, wherein said at least one heat absorbing media is selected from a group consisting of silicon carbide, silicon, silica, iron impregnated quartz and sand.

3. The microwave heating system according to claim 1, wherein at least one component of said at least one heat absorbing media is selected from a group consisting of silicon carbide, silicon, silica, iron impregnated quartz and sand, and wherein said at least one component of said at least one heat absorbing media is between about 23 percent to about 43 percent of the content of said at least one heat absorbing media.

4. The microwave heating system according to claim 1, wherein said at least one heat absorbing media is selected from a group consisting of silicon carbide, silica and iron impregnated quartz.

5. The microwave heating system according to claim 1, wherein said at least one heat absorbing media is selected from a group consisting of silicon carbide, silica and iron impregnated quartz, and wherein said silicon carbide, silica, and iron impregnated quartz are in about a one third proportion in said at least one heat absorbing media.

6. The microwave heating system according to claim 1, wherein said at least one heat absorbing media is selected from a group consisting of silicon carbide, silica and iron impregnated quartz, and wherein at least one component of said at least one heat absorbing media is between about 23 percent to about 43 percent of the content of said at least one heat absorbing media.

7. The microwave heating system according to claim 1, wherein the number of heating rods is between 1 rod to 5 rods.

8. The microwave heating system according to claim 1, wherein said means including at least one magnetron further includes at least one microwave wave guide mounted on each said at least one heating rod, said at least one magnetron being mounted on said at least one microwave wave guide.

9. The microwave heating system according to claim 1, further including at least one fan for cooling said at least one magnetron.

10. The microwave heating system according to claim 1, further including at least one capacitor and at least one transformer for supplying electrical energy to said at least one magnetron.

11. The microwave heating system according to claim 1, further including:

at least one coil for heating said domestic hot water coiled about said at least one heating rod; and at least one coil inlet and at least one coil outlet for internally conveying said domestic hot water into and out of said at least one coil and wherein said at least one coil coiled about said at least one heating rod is externally surrounded by said heating media contained in said at least one tank.

12. The microwave heating system according to claim 1, further including:

at least one coil for heating said domestic hot water coiled about said at least one heating rod;

at least one coil inlet and at least one coil outlet for internally conveying said domestic hot water into and out of said at least one coil, and wherein at least a portion of said at least one coil is coiled about a lower section of said at least one heating rod; and wherein said at least one coil coiled about said at least one heating rod is externally surrounded by said heating media contained in said at least one tank.

13. The microwave heating system according to claim 1, wherein at least one content of said at least one heat absorbing media is selected from a group consisting of a fine powder, a granular powder, a fine dust, and a granular dust.

14. The microwave heating system according to claim 1, wherein said at least one tank has at least one temperature probe.

15. The microwave heating system according to claim 1, wherein at least one partition divides said enclosure into an upper compartment and a lower compartment;

said upper compartment contains said magnetron chamber and an upper section of said at least one heating rod; and said lower compartment contains said at last one tank and a lower section of said at least one heating rod.

16. A dual microwave heating system for beating a fluid heating, media and domestic hot water, the microwave heating system comprising:

an enclosure;

at least one tank located within said enclosure;

at least one magnetron chamber located within said enclosure above said at least one tank;

at least one heating rod with a hollow interior extending from said at least one magnetron into said at least one tank, said at least one heating rod having an upper section located in said at least one magnetron chamber and a lower section located in said at least one tank;

at least one heat absorbing media located within said hollow interior of each heating, rod;

at least one microwave wave guide located at an upper section of each said heating rod;

at least one magnetron mounted on each said microwave wave guide to heat said at least one heat absorbing media, and wherein said at least one heat absorbing media heats said at least one heating rod, and wherein said at least one heating rod heats said fluid heating media and said domestic hot water; and at least one heating media inlet and at least one heating media outlet for conveying said fluid heating media into and out of said at least one tank;

at least one domestic hot water inlet and at least one domestic hot water outlet in said at least one tank for conveying said domestic hot water into and out of said at least one tank;

wherein said fluid heating media and said domestic hot water do not corningle;

wherein said at least one heating media inlet operates independent from said at least one domestic hot water inlet; and wherein said at least one heating media outlet operates independent from said at least one domestic hot water outlet, and thereby forming said dual microwave heating system for heating said fluid heating media and domestic hot water.

17. The microwave heating system according to claim 16, further including:

at least one coil for heating said domestic hot water coiled about said at least one heating rod; and at least one coil inlet and at least one coil outlet for internally conveying said domestic hot water into and out of said at least one coil; and wherein said at least one coil coiled about said at least one heating rod is externally surrounded by said fluid heating media contained in said at least one tank.

18. The microwave heating system according to claim 16, further including at least one capacitor and at least one transformer for supplying electrical energy to said at least one magnetron.

19. The microwave heating system according to claim 16, wherein said at least one heat absorbing media is selected from a group consisting of silicon carbide, silicon, silica, iron impregnated quartz and sand.

20. A dual microwave heating system for heating a fluid heating media and domestic hot water, the heating system comprising:

an enclosure;

at least one tank located within said enclosure;

at least one magnetron chamber located within said enclosure above said at least one tank;

at least one heating rod with a hollow interior extending from said at least one magnetron chamber into said at least one tank, said at least one heating rod having an upper section located in said at least one magnetron chamber and a lower section located in said at least one tank;

at least one heat absorbing media located within said at least one heating rod;

at least one microwave guide located at said upper section of said at least one heating rod;

at least one magnetron mounted on said at least one microwave guide to heat said at least one heat absorbing media, and wherein said at least one heat absorbing media heats said at least one heating rod, and wherein said at least one heating rod heats said fluid heating media and said domestic hot water;

at least one coil for heating said domestic hot water coiled about each said heating rod;

at least one coil inlet and at least one coil outlet for internally conveying said domestic hot water into and out of said at least one tank; and at least one heating media inlet and at least one heating media outlet for conveying said fluid heating media into and out of said lower section of said at least one tank; and wherein said fluid heating media and said domestic hot water do not comingle;

wherein said inlet for said fluid heating media operates independent from said inlet for said domestic hot water, and wherein said outlet for said fluid heating media operates independent from said outlet for said domestic hot water and thereby forming said dual microwave heating system for heating said fluid heating media, and domestic hot water.

* * * * *